US005468184A

United States Patent [19]

Collier

[11] Patent Number: 5,468,184

[45] Date of Patent: Nov. 21, 1995

[54] AIR CIRCULATION SYSTEM FOR ENCLOSED STRUCTURES

[76] Inventor: William R. Collier, 137 St. Pierre, Montreal, Quebec, Canada

[21] Appl. No.: 136,564

[22] Filed: Oct. 13, 1993

[51] Int. Cl.[6] ..... F24F 7/08

[52] U.S. Cl. ..... 454/186; 454/230; 454/307; 454/287

[58] Field of Search ..... 454/185, 186, 454/228, 230, 232, 233, 236, 287, 307, 309

[56] References Cited

U.S. PATENT DOCUMENTS

| | | | |
|---|---|---|---|
| 1,473,648 | 11/1923 | Scherer | 454/232 |
| 1,624,225 | 4/1927 | Elters | 454/307 |
| 2,206,119 | 7/1940 | Persons | 454/186 |
| 2,796,015 | 6/1957 | Hayes | 454/287 |
| 3,458,130 | 7/1969 | Juhlin | 454/232 X |
| 3,516,347 | 6/1970 | May | 454/185 |

FOREIGN PATENT DOCUMENTS

| | | | |
|---|---|---|---|
| 142141 | 7/1985 | Japan | 454/233 |
| 2775 | 1/1916 | United Kingdom | 454/230 |

*Primary Examiner*—Harold Joyce
*Attorney, Agent, or Firm*—James T. FitzGibbon

[57] ABSTRACT

A forced air circulation system for an enclosed room with a floor, room walls, and a ceiling. The system includes at least one distributor unit positioned adjacent the base of at least one of the room walls. The distributor unit has an elongated center section, an inlet opening for receiving forced circulation air, and an elongated outlet passage of smaller cross-sectional area than that of the inlet opening. The system also provides a deflector unit positioned on the room wall substantially upwardly of the distributor outlet passage. The deflector unit has surface portions approximately parallel and perpendicular to the wall surface as well as a transition portion connecting these surfaces. Supply and return conduits are provided for directing forced air to the distributor unit inlet and withdrawing the circulated air from the room.

14 Claims, 3 Drawing Sheets

78
46
88
80
76
82
46
58
68
64x
64y
66
74
70
72
43

58x
52x
50x
64x 58
47
44e
60b
64b
58b
58a
64a 52b
52a
60a
42
50b
56a
50a
56b
25
54
43
43
122
58
120
118
24
45
49
41
40
116
114
26

44
100
96
98
110
112
22
25
108
106
47a
35
102
104
33
24
32b
33
32c
34
92
33
26
33
36
90
94
28
18

AIR CIRCULATION SYSTEM FOR ENCLOSED STRUCTURES

The present invention relates generally to air circulation systems for enclosed structures, and more particularly, to an arrangement of air supply ducts, air distributors, and air deflectors to achieve controlled air circulation within an enclosed structure.

In one embodiment, the invention relates to a system for directing air within a building structure to desired areas without the use of ducts passing within the walls or ducts rising above floor level, while avoiding most or all of the drawbacks of distributing air into an interior building space by way of outlets in the ceiling, the walls, or at floor level.

An important aspect of the present invention is the arrangement of an air distribution system capable of directing air from a pressure or forced air circulation source to what may be termed a distributor element adapted to form a part of, or to lie along or to be otherwise closely spaced apart from, a baseboard, and to form a film or sheet of air and direct such film or sheet of air vertically along a wall surface, and thereafter, using wall-mounted fixed or movable deflectors, direct a major portion of such air toward the building interior.

As presently constituted, the invention uses an underfloor plenum, preferably serving a relatively wide area, as the source of conditioned air that is supplied to one or several baseboard-style distributor units covering a major portion of the length of at least one building wall. These units are constructed and arranged so as to have one or more outlets of a cross-sectional area relatively small compared to the cross-sectional area of the air supply passage, and to be configured so as to create a vertically directed sheet, film, or thin column of air flowing along a vertical wall surface.

Further in keeping with the invention, air deflectors are placed at a suitable height, which depends on the application, so as to be able to direct the conditioned air into selected portions of the interior room or space. Most or all of the deflectors are preferably mounted on the walls in an inconspicuous manner. As used herein, "conditioned air" is used in its broadest sense, to include heated, cooled, humidified, filtered, or otherwise treated air.

One important feature of the invention is the ease of achieving air circulation by "tapping into" an area-wide forced circulation air plenum lying beneath a work area interior floor, and to achieve above-floor circulation without the need for vertical ducting lying within or adjacent the building walls. Such a wide area isolated plenum system is described and claimed in U.S. Pat. No. Re. 33,220, for example. Using the present inventive structure can further avoid the need for registers, grates, or other supply outlets in the building floor.

The reasons for this are several. First, where an air circulation system is being utilized in a non-dedicated area, i.e., in an office, a residence, a hospital room, or the like, as opposed to a dedicated, special purpose application such as a computer room, it is usually desired that the floor be as free as possible from openings, particularly air supply openings, therein. Reasons for this include, but are not limited to, a desire to avoid air drafts directed onto the feet of office or other workers.

While it may be in some cases that electrical outlets or the like are desired to be placed in the floor, the presence of air flow grates or registers is often unsightly and sometimes undesirable for other reasons. Such installations prevent the effective use of carpeting, for example. The positioning of furniture or the like within a given area can be unduly restricted by the requirement that air registers remain uncovered. Thus, in some cases, moving the furniture may obstruct the air circulation potential and thus compromise the effectiveness of air circulation.

It goes without saying that covering and uncovering registers or the like, although theoretically possible, is inconvenient and expensive, and particularly under circumstances wherein carpeting needs to be removed or replaced to provide or close off openings. Even in instances wherein carpet tile or the like is present, there is significant inconvenience and aesthetic compromise involved in providing floor registers or other outlets.

Moreover, while air circulation from overhead ducts has been suggested and is commonly used in home and offices, the problem of air return in such applications has not always been addressed satisfactorily. Thus, while providing supply air and taking return air from the building ceiling is a common approach, the downdraft effect of chilled air emanating from ceiling ducts tends to produce localizing "cold spots" and "hot spots" within the room. This is a common source of worker complaints.

Moreover, registers or outlets for refrigerated air that are located away from the walls, but close to one another, tend to create vertical walls or curtains of air, with a "zoning" effect as the downward velocity of the forced air supply is augmented by the increased density of conditioned or cold air. The need to provide lighting in building ceilings works against the requirement of providing air flow ducts and/or other passages wherever needed to provide overhead air circulation. In other words, the lighting locations pre-empt the preferred locations for positioning circulated air outlets. This may render later modification of building interiors problematical and unsatisfactory. Hence, a shoulder or waist level source of fresh, conditioned air, used with low level returns, has significant potential for good air distribution and improved comfort, serving to heat or cool the interior of rooms of reasonable size without creating hot or cold spots or undesirable zoning effects., provided that distribution can be achieved satisfactorily. The present invention provides an easy and convenient way to create air flow and/or distribution within interior areas, using the walls but without requiring the interior ducts and registers previously thought necessary.

Referring to another aspect of the invention, the ability to achieve substantially laminar or sheet-wise flow of air along a wall surface by proper placement and shaping of air outlets can be utilized for air distribution, especially when combined with the use of inconspicuous deflector units that can be placed at any desired height along a full height or stub wall, or along another vertical surface. Thus, if there is reason to direct air substantially horizontally at a desired height to provide air circulation or cooling in the vicinity of a worker, or at or near a desk, a pod, or a pedestal-mounted piece of equipment, or other work station, this can be readily achieved. Hence, the effect of having wall outlets can be achieved without the need for ducts and unsightly grills or the like. The location of the air flow deflectors may be easily changed without affecting the aesthetics or structural integrity of the area walls.

According to the present invention, the air circulation system is preferably used in conjunction with one or more area-wide air distribution plenums, but the concept may be employed without such plenums.

In view of the shortcomings of prior approaches to interior air distribution, it is an object of the present invention to provide an improved distribution system for forced circulation, conditioned air.

Another object of the invention is to provide a distribution system for conditioned air in which air is distributed from a source through one or more manifolds or distributor units having a high length-to-width ratio, measured parallel to an associated wall, and adapted to create air flow along obstruction-free vertical building walls, used in conjunction with fixed or movable air deflectors spaced a desired distance vertically apart from the building floor.

Another object of the invention is to provide a system for distributing conditioned air at minimum cost and without disturbing the area interior.

Yet another object of the invention is to provide a system of air distribution wherein supply and return air are furnished to and taken from the interior of a building at or near a baseboard wall area, yet wherein air effectively enters the room as though it entered from a higher level.

A further object of the invention is to provide a conditioned air circulation system wherein high velocity thin sheets or films of air are utilized to achieve interior air distribution in a "ductless" application.

A still further another object of the invention is to provide an interior air circulation system for a building room wherein the air is supplied in vertically moving sheets or films directed along the wall surface and which are thereafter, by reason of air deflectors positioned on the wall, directed to the room interior to an extent determined by their position.

Another object of the invention is to provide a conditioned air distribution system providing for increased user comfort relative to known prior art systems.

Yet another object of the invention is to provide an air distribution system that is readily used in connection with various kinds of remotely sourced cooled air, and which system is compatible with an associated smoke evacuation system.

Still another object of the invention is to provide an air circulation system wherein localized control of air circulation volume can be achieved at low cost and wherein temperature control within certain zones can be achieved within a room interior at minimum expense.

The foregoing and other objects of the invention are achieved in practice by providing an air circulation system for connection to a source of forced circulation air, which system comprises ducts or passages extending from an air source to a distributor unit forming a part of or positioned along a baseboard, an elongated manifold or distributor unit having an outlet of relatively small cross-sectional area, and being of substantial length along the wall relative to its depth, whereby a high velocity sheet or film of air is formed and directed vertically along an associated wall surface, with the wall including at least one air deflector unit spaced above the baseboard and having a curvilinear surface effective to direct air toward the room interior in a flow pattern substantially perpendicular to the vertical extent of the associated wall surface.

The objects are also achieved in part by providing a return air system, including a baseboard collector unit having plural spaced apart air return inlet areas and including one or more ducts for connection to a return air area generally.

The manner in which the foregoing and other objects and advantages of the invention are achieved in practice will become more clearly apparent when reference is made to the following detailed description of the preferred embodiments of the invention set forth by way of example and shown in the accompany drawings, wherein like reference numerals indicate corresponding parts throughout.

DESCRIPTION OF THE PREFERRED EMBODIMENTS OF THE INVENTION

While the present invention may be embodied in a number of building structures and the elements may vary considerably in detail, a description of the preferred form of invention will be given wherein the portion of the building served by the invention is an office space; wherein the space in question includes an underfloor area having a wide area, separate air supply plenum lying on a different horizontal level than a wide-area return air plenum disposed beneath it and wherein a portion of the subfloor space is also dedicated to services, including electrical and other services, intended to be isolated from the forced air stream.

According to the invention, multilevel floors such as those described in U.S. Pat. Nos. Re. 33,220 and 4,874,127 provide considerable advantages in the areas of code compliance, fire safety, and as has now been discovered, a potential for smoke evacuation. These floors incorporate an air distribution system that is totally isolated from an electrical distribution system. Particularly where it is desired to have ready access to the electrical conductors or other underfloor services, this can be done without sacrificing flexibility in providing air circulation, including air return, by placing air flow control elements in the vicinity of vertical wall surfaces, including those in a room periphery or surfaces forming portions of a desk or other work station.

In applications such as hospitals or the like, the underfloor area can provide access to services including oxygen or other gases, data lines connecting medical instruments or monitors in a patient room with master display units or remote monitors, as well as the more customary elements such as line voltage electrical wiring, telephone wires, and, in the administrative areas, interconnect cable and the like for computers. The remainder of the underfloor space can provide an air circulation and distribution system having numerous advantages.

Figure 1:
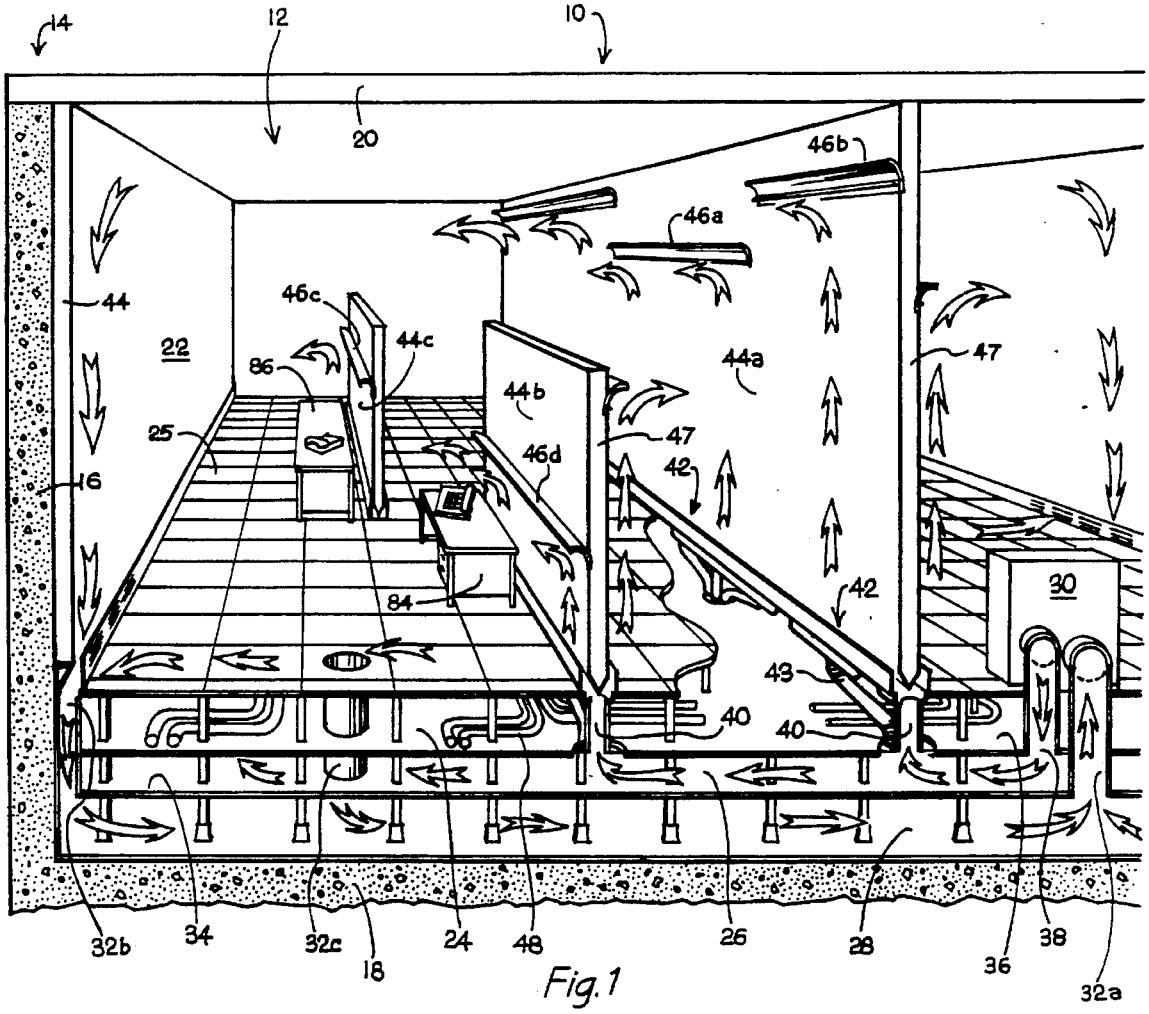
FIG. 1 is a perspective view, with portions broken away, showing a room including the novel air circulation system of the invention.

Referring now to the drawings in greater detail, FIG. 1 shows the invention to be embodied in an air circulation system generally designated 10 that is incorporated into parts of the structure of a room generally designated 12 lying inside a larger building structure generally designated 14.

As shown, the building structure includes any appropriate number of vertical walls 16, a horizontal floor slab 18, and a ceiling 20 which may be a "false" or dropped ceiling or which may be a structural slab or other member. For purposes of the present invention, ceiling construction is unimportant. In the preferred form of the invention, the room 12 defined by the floor and ceiling 18, 20, and the wall 16 includes four separate spaces, an above-floor or working area space 22, a first subfloor space 24, a second subfloor space 26, and a third or lowermost subfloor space 28.

According to the invention, various vertical passages to be described in detail herein permit circulation of air through the one or more horizontal levels below the work floor 25 and into the desired dedicated horizontal spaces or levels 24, 26, 28 just described. Another feature of the invention is its adaptability for use with a heating, cooling, filtering or other climate control unit 30 which is shown, merely for purposes of illustration, to be in the form of a box or the like understood to have forced circulation means such as a fan (not shown) and one or more sources of climate control (also not shown) such as a low temperature coil, one or more heating coils, humidifiers, filters, precipitators or the like, the exact construction of which is known to those skilled in the art and does not per se form a part of this invention.

According to the invention, the lowermost space 28 is a substantially unobstructed, wide area space that is in communication with one or more vertical passages 32*a* that provide communication between the space 28 and the climate control unit 30 in the interior room work space 22 above the work floor 25. Referring still to FIG. 1, near the left side of the drawing, there is shown a second vertical passage 32*b*, through which air is shown to pass downwardly, and a third vertical passage 32*c*, which also provides a substantially air-tight downward air flow passage into the space 28. Thus, the space 28 is shown to include not only the wide area underfloor space above the building slab 18 and below the space 26, but also all of the substantially air-tight vertical passages just described. Collectively, the vertical passages 32*a–c* and the underfloor space 28, when taken with the baseboard collectors and return to be described, provide the return air system of the invention.

It will naturally be understood, in view of the modular construction and the fact that the invention is applicable to rooms of all sizes, that only a single passage 32*a* is shown to furnish return air to the climate control unit 30, and that only two return flow or collector passages 32*b*, 32*c* are shown in communication with the lower space 28. In reality, any appropriate number of such passages can and normally will be provided.

Referring still to FIG. 1, an intermediate space 26 is shown to be defined between a lowermost raised floor 34 and an intermediate raised floor 36. This space 26 is for supply air, and hence the space includes a main air supply vertical passage 38, extending from the unit 30, as well as a plurality of vertically extending room air supply stub ducts 40 adapted to pass supply air under fan pressure to the remaining parts of the air circulation system described herein. For functional purposes, the supply passages 38, 40 and the underfloor space 26, all being in communication with each other, are considered to comprise a major portion of the supply air system.

Figure 4:
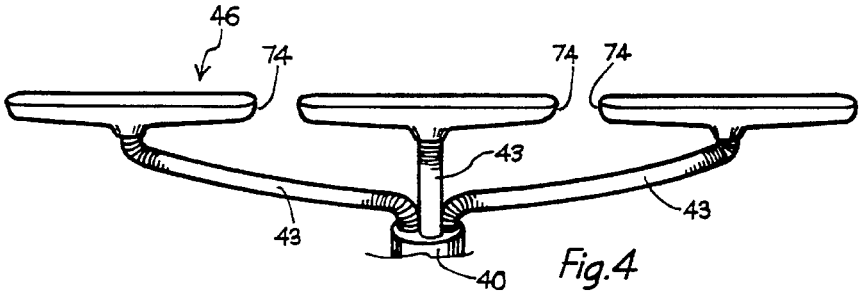
FIG. 4 is a perspective view of a preferred form of certain elements of the air distribution system of the present invention.

Further, according to the invention, a plurality of baseboard "distributor" units generally designated 42 also form a key part of the air supply system; these distributor units are provided for the purpose of conducting the conditioned air from the wide area subfloor space 26 and forming the air into one or more sheets or films intended to travel vertically along an associated wall. Each of these baseboard distributor units 42 is supplied through a conduit 43 whose distal or downstream end terminates in the distributor unit 42 to be described in detail later (FIGS. 4–6).

Referring again to FIG. 1, each of a plurality of interior building wall surfaces 44*a*, 44*b*, 44*c*, for example, extends vertically to whatever height is appropriate, considering the intended use of the interior building space. In the illustrated form, wall surface 44*a* is of full, floor-to-ceiling height, while wall surfaces 44*b* and 44*c* are stub walls, i.e., those of less than full floor-to-ceiling height. As is shown, each of the walls contains, at a suitable height, one or more deflector units 46*a*, 46*b*, 46*c*, 46*d* to be described in more detail herein. The walls 44*a*, 44*b*, etc. are preferably non-load-bearing walls, even though they might be structural members in the case of floor-to-ceiling walls. For present purposes, each wall is considered to have a core 47 as well as exterior surfaces.

Referring again to FIG. 1, it will be noted that an uppermost space 24 lying immediately beneath the work area floor 25 is adapted to receive wires and/or cables 48 or the like. This space 24 is mechanically isolated by the combination of the work floor 25, the intermediate raised floor 36, and whatever walls are required. The purpose of this arrangement, i.e., dedicating a separate, substantially air tight space to electrical wires or other services is to insure that, for reasons of electrical and other code compliance, as well as common sense, any potential fire hazard associated with the wires, if realized, will not create flame or smoke within a forced circulation air space. There are numerous other advantages associated with this level-wise separation of services, including ease of compliance with building codes, favorable insurance rates and in general, the ability to provide safety for occupants in an effective, yet inexpensive manner. It has now been found, however, that in many cases, the most significant advantage is that great energy savings are available because the air is directed to its destinations through a virtually unobstructed air supply space. Provision of a similar return air space adds to this advantage. Further descriptions of this system are described in detail in U.S. Pat. No. Re. 33,220, and U.S. Pat. No. 4,874,127, and in literature published by Interstitial Systems of the Chicago area, referring to the "Infinity" floor systems offered by such company.

Figures 2, 5, 6:
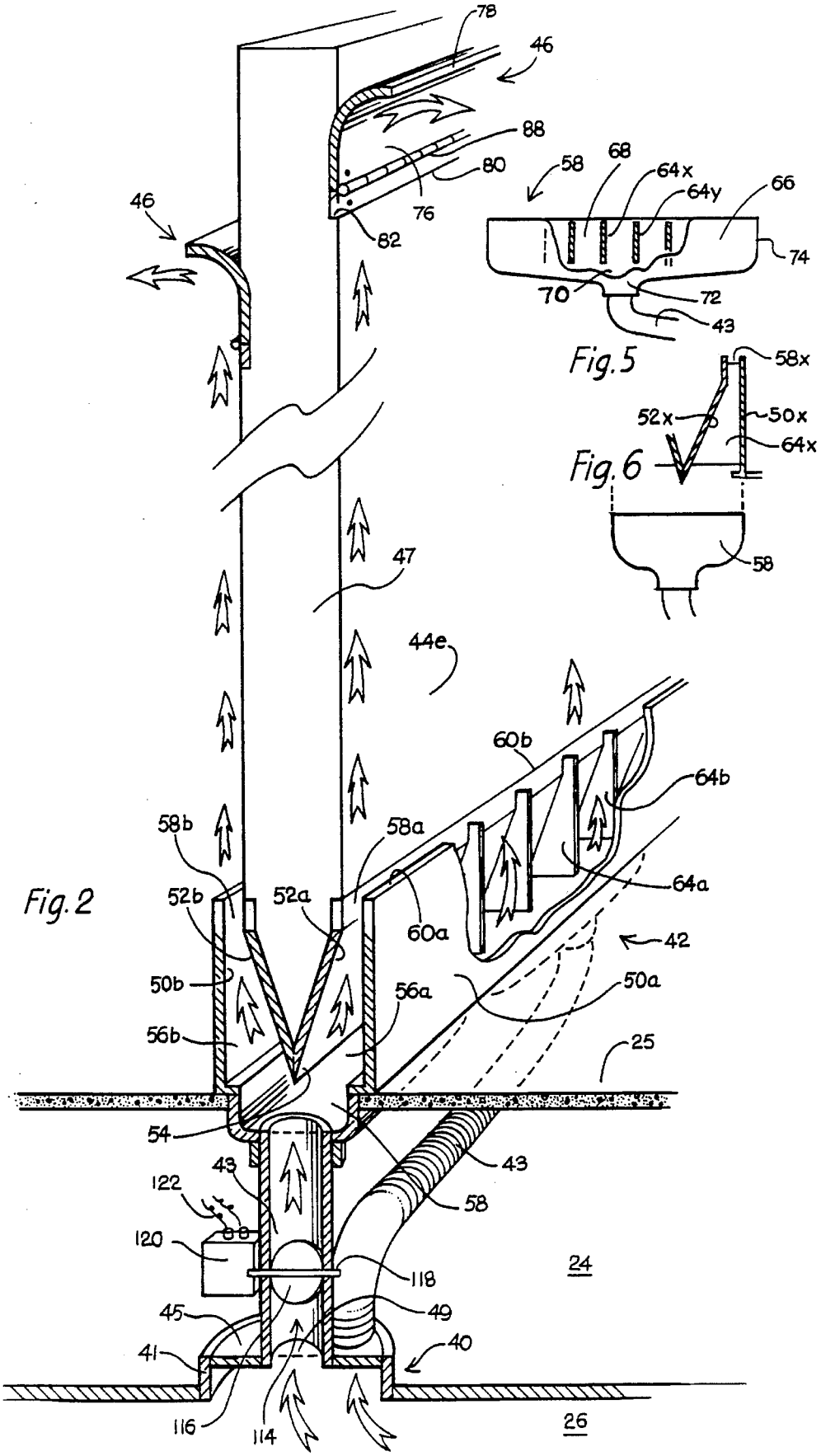
FIG. 2 is a perspective view, with portions broken away, similar to that of FIG. 2, but taken on an enlarged scale and showing certain features of the air supply system.
FIG. 5 is a front elevational view, with portions broken away, showing certain details of one embodiment of the air distribution unit of the invention.
FIG. 6 is a fragmentary vertical sectional view, showing two elements of the air distributor unit of the invention in an exploded relation.

Referring now to FIG. 2, additional details of the distributor 42 located near the baseboard and comprising an important part of the invention are illustrated. These elements are also shown in FIGS. 4–6. In FIG. 2, a typical wall with an inwardly facing surface 44*e* is shown to include a built-up distributor assembly generally designated 42, and comprised of several components. As is shown, a pair of exterior baseboard plates 50*a*, 50*b* extend horizontally along and are joined at their lower margins to the surface of the floor 25. The lower margin of the wall core 47 is formed by inclined or tapered sidewalls 52*a*, 52*b*, meeting along a lower edge 54. This arrangement divides the area in the vicinity of the baseboards 50*a*, 50*b* into a pair of opposed, elongated and tapered areas 56*a* and 56*b*, each being in communication with a trough 58 serving, in effect, as an air manifold. Because these areas 56*a*, 56*b* taper towards a narrow outlet, they serve as air velocity accelerators as well as film or sheet formers for the air. Each distributor 42 has outlets 58*a*, 58*b* of very narrow cross-section, defined by the closely spaced apart respective upper edges 60*a*, 60*b* of the plates 50*a*, 50*b*, and walls 52*a*, 52*b*. The vertical positioning of the baseboard walls 50*a*, 50*b* and the reduced cross sections of the outlets 58*a*, 58*b* combine to create very high velocity, substantially completely vertical air flow patterns. A plurality of flow-directing inner vanes 64*a*, 64*b*, etc. of truncated triangular shape preferably subdivide the area 56*a* into adjacent regions of the same shape and having parallel air flow therein. The vanes 64*a*, 64*b* are usually perpendicular to the floor to insure that flow is as purely vertical as is possible. Of course, they could be inclined outwardly to "fan out" and cover a larger area if desired.

Accordingly, FIG. 1 shows the general layout and operation of the air circulation supply system, namely, that there is a wide area air supply plenum that is periodically "tapped into" by passages that lead to air distributor units 42.

Referring to FIGS. 5 and 6, two different embodiments of the distributor apparatus are shown. In FIG. 5, the elements shown in FIG. 2 are combined into a single, integrated unit that is independent of the floor structure, i.e., this unit includes front and rear sidewalls 66, 68 that do not form a part of the wall structure. It also includes an elongated, internally open, trough-like area 70 adjacent the inlet 72 at the end of the conduit 43 which joins the distributor unit 42. In the type of construction illustrated in FIG. 5, the sidewalls 66, 68, the end walls 74 and the vanes 64, 64*x*, 64*y*, etc. are constructed and arranged so that vertical, high velocity flow emerges from the outlet end 58 of the distributor unit. Accordingly, the unit can be positioned adjacent the intersection of an existing vertical wall and the floor and utilized in that way. In the alternative, the unit may be manufactured as a single distributor unit, but positioned in a manner similar to that shown in FIG. 2, having its vertical surface 66 simply covered with a molding such as that shown as 50*a* in FIG. 2.

FIG. 6 shows a construction similar to that of FIG. 2, showing the manner in which the trough portion 58 may be separably positioned beneath the vertical and tapered walls 50*x*, 52*x*, for example. This view also shows a configuration of the vane 64*x*, which achieves vertical flow and shows that the outlet area 58*x* is of greatly reduced cross-section relative to the mouth or open portion of the trough 58. FIG. 6 illustrates that, where the wall is made in one-half the thickness of the wall shown in FIG. 2, for example, a single width trough portion of the distributor unit may simply be emplaced in the open space between the adjacent panels forming the floor 25, and the remainder of the distributor 42 can be formed using an existing wall surface 52*x* and a baseboard cover 50*x*, to which the vanes 64*x* are attached.

Referring now to another aspect of the invention, FIG. 2 shows a deflector unit generally designated 46 to include a curvilinear inner surfaces 76, and a generally horizontal edge 78. The deflector 46 is shown as being positioned so that its inner surface 76 is flush with the adjacent wall surface 44*e*. In this case, the lower edge 80 of the deflector abuts a small ledge 82 in the wall surface. A piano hinge 88 or the like may be used to adjustably position this or similar deflectors. A counterpart unit also designated 46 is shown to be positioned on the opposite side of the vertical wall 44 where it serves to deflect air current exiting from the opening 58*b*. In operation, the deflector, in the preferred form, provides a right angle or 90° change of air direction, and will direct the high velocity sheet or film of air traveling upwardly along the wall toward the room interior as shown by the arrows in FIG. 2. By reference to FIGS. 1 and 2, it will be seen that the deflectors 46 may be of any desired height and are simply positioned so as to direct the air to the vicinity of occupants, machines, or otherwise as indicated by conditions within the room. This is an important feature of the invention.

FIG. 1 shows that in some cases, the deflector may be used adjacent a desk or the like 84 to direct conditioned air toward the vicinity of the head or shoulders of the seated person while in the case of another desk 86, the flow of air may be directed somewhat over the head and shoulders area of an occupant. The drawing also shows the positioning of deflectors at different heights primarily for purposes of illustration.

The lower portion of FIG. 2 also shows that each of the individual distributors 42 is provided with air by a connection between the tube or conduit 43 that extends outwardly from a generally cylindrical stub duct or short passage 40 and defined by a stub wall 41 closed off by a cover plate 45 having an opening 49 for each of the conduits 43. Preferably, as illustrated in FIG. 4, there are three conduits 43, each serving a distributor unit 42 and preferably each distributor unit has its end portions 74 spaced closely apart from the ends of an adjacent unit so as to provide relatively complete flow coverage along any given wall. Of course, it is understood that the distributor units may be spaced apart from each other if less than complete coverage is desired for some reason.

Figure 3:
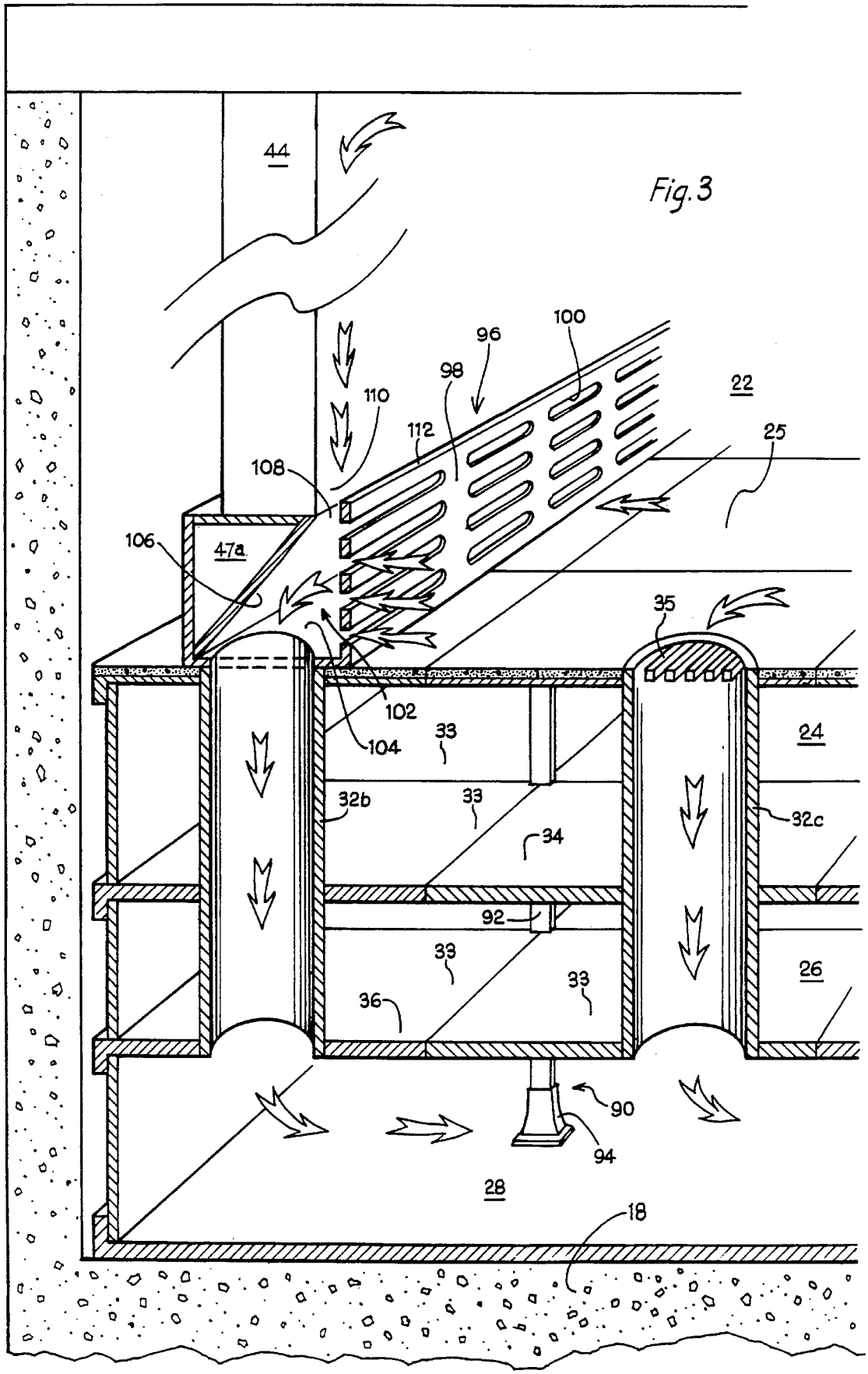
FIG. 3 is a perspective similar to that of FIG. 2, also taken on an enlarged scale and showing various features of the air return system and the floor construction of the invention.

Referring now to FIG. 3, there is shown another portion of the floor 25 and portions of a building wall 44. FIG. 3 also shows certain constructional details of a modular combination raised floor wireway and conditioned air distribution system, such as that illustrated in the specification and drawings of U.S. Pat. No. Re. 33,220 and U.S. Pat. No. 4,874,127. As shown here in FIG. 3, a floor support column generally designated 90 is shown to include a vertical support portion 92 disposed above a pedestal 94 having an enlarged base portion and resting on the floor slab 18. The lowermost and intermediate floors 36, 34 defining portions of the air supply and return spaces respectively are shown to be provided in the form of separate, modular, easily removable panels 33 supported on a bracket and stringer system of the type shown in U.S. Pat. No. Re. 33,220. Any other suitable form of construction may also be used, it being understood that a modular access type floor is preferred as providing increased convenience of service and other advantages.

According to the present invention, two levels should be provided for supply and return air, and one or more additional levels may, but need not be, provided for accommodating wires and the like. In the preferred form of the invention, one or two wireway levels are provided in association with air flow levels, the air spaces or plenums 26, 28 being approximately equal to or just slightly smaller than the overall dimensions of the room and free of internal obstructions except for occasional pipe and the portions of the support columns which serve to position the floor above the slab 18.

FIG. 3 also shows that a baseboard collection and return air unit generally designated 96 is provided as a way of avoiding openings in the floor, if this is desired for any of the reasons herein referred to. The collector and return unit 96 is shown to be comprised of a baseboard face plate 98 having plural apertures 100 therein and thus allowing communication with the collection space generally designated 102 and defined by a floor element 104 and a tapered wall 106 facing the lower margin of the wall core 47*a*. There is also an elongated narrow inlet space 108 defined between the respective upper edges 110, 112 of the tapered wall 106 and the baseboard faceplate 98. According to this illustration, it will be noted that vertical air flow passing generally downwardly along the wall unit 44 may pass through the elongated open space 108 and into the enlarged collection area 102. Thence, the collected return air will pass downwardly as shown by the arrows through the vertical passage 32*b* and into the return air plenum 28 for recirculation through the unit 30 (FIG. 1).

FIG. 3 shows that, in the alternative, or simultaneously, air may pass through the openings 100 into the collection space 102 from areas generally near the floor, and also in the manner indicated by the directional areas. In the interior of the space 102, air flow is the same as that just described.

According to the invention, therefore, the baseboard collection units may receive air flowing downwardly along the wall and into the upper opening, through the openings in the perforated panel, or both. The return air baseboard arrangement may either eliminate the narrow, elongated openings 102 or the elongated apertures 100, relying only on the other, or it may incorporate both forms of return air passages.

Likewise, referring again to FIG. 3, it will be noted that one of the modules or units containing floor panels 33 includes a return air vertical passage 32*c* having protective grillework 35 protecting the uppermost opening therein. As shown by the directional arrows, return air may also be drawn from anywhere inside the above-floor area of the room 22 and returned through this or a similar passage 32*c* into the return air space from which it may be taken through passage 32*a* (FIG. 1) to the conditioning and/or heating unit 30 for recirculation.

Accordingly, it is not strictly necessary in accordance with the invention that a particular form of return air collection device be used and it is apparent that the construction of the building including its length, width and aspect ratio generally will determine the position of the return air ducts. Each of the collector unit arrangements has its characteristic advantages and selection or choice between them is left to one skilled in the art.

Referring now to the use of the invention, it is believed highly advantageous for use in business environments such as offices. In such an arrangement, a number of above-referenced and additional advantages can be provided. First, individual flow control may be achieved by placing a damper generally designated 114 in one or more of the supply passages 43 (FIG. 2), the damper including a plate 116, a pivot shaft 118, a motor 120, and means such as wires 122 for connection to a remote control unit. The use of such a damper, in a manner known to those skilled in the art, can be used to achieve a "zoning" effect, i.e., a control of temperature within various zones of a room as a whole. U.S. Pat. No. 4,874,127 explains how such dampers may be incorporated into a Local Area Network ("LAN") control system.

By positioning the deflectors wherever desired, i.e., at whatever height and whatever angle it is desired, close control over air direction can be achieved without requiring access to ductwork within the walls. For generalized air circulation within a room, the deflectors may be placed relatively close to the ceiling, but when it is desired to achieve a greater air flow in the vicinity of a work station, for example, this can be achieved by simply placing the deflector unit in a position that is convenient for the work station operator.

While it is not absolutely necessary that the air supply system be used in connection with a wide area plenum, this achieves significant advantages, inasmuch as, for reasons of design flexibility, it is possible to achieve a fully customized form of air circulation with minimum difficulty. Thus, wherever it is desired, a stub duct 40 may be positioned within the modular floor system, and the distributor outlets 42 may be placed adjacent any stub wall or other vertical surface, with such surface then being able to be equipped with a deflector. The width and height of the stub wall and its construction is left strictly to the choice of the designer. By using the area-wide supply plenum, therefore, the advantages of an almost infinite choice of location can be achieved. The use of the laminar flow upwardly along the walls in a film or sheet form has the advantages already discussed.

While the exact dimensions of the various elements of the invention are not crucial, it is desirable that certain ratios at least be approximately achieved. In this connection, for each distributor unit, its inlet, i.e., the end in communication with the conduit 43, should have a cross-sectional area that is larger than the cumulative cross-sectional area of the outlet space 58 defined between the upper edges of the walls of the baseboard unit and the wall margin or its equivalent. Thus, in a distributor unit three feet in length, a one-quarter inch width outlet would provide nine square inches of area. In such a case, the inlet passage or conduit might be of four inch or larger diameter, thus providing a cross-sectional area of about 12.5 square inches. Such an arrangement would insure a greater discharge air velocity than the velocity within the conduit 43. Naturally, the constricting effect created by the cumulative outlet area versus the area of the supply conduits can influence this effect, as can the overall pressure in the air supply plenum. An alternate manner of achieving increased vertical air flow velocity can be achieved by elevating the pressure in the air supply space 26 as desired. Pressures readily achievable in such an air space without leakage sufficient to create hazards or loss of cooling effectiveness have been achieved in the order of about 0.5 to 0.7 or more inches of water, with pressure levels of 0.4 inches of water being readily achievable.

The present invention provides a simple and effective method of providing customized control of air flow by means of distribution at varying points along a vertical wall without dependence on floor level outlets or hollow walls or separate ducts to achieve directional flow. The invention provides further advantages of modularity and variation in application by its advantageous association with a multi-level wide area air supply and return plenums to which access may be had by an arrangement of modular passages, including passages through which air flow may be controlled by known means. It will thus be seen that the present invention provides an air circulation system having a number of advantages and characteristics, including those referred to specifically herein and others which are inherent in the invention. Various preferred embodiments having been described in detail, by way of example, it is anticipated that modifications and variations in the described form of construction will be apparent to those skilled in the art, and that such variations may be made without departing from the spirit of the invention or the scope of the appended claims.

I claim:

1. A forced air circulation system for an enclosed room having a floor, room walls, and a ceiling, said room walls having surfaces facing toward the interior of said room, said circulation system comprising, in combination, at least one distributor unit positioned adjacent the base of at least one of said room walls, said distributor unit including walls defining an elongated center section of a given width, an inlet opening whereby said distributor unit may received forced circulation air, and an elongated outlet passage formed by closely spaced apart upper edges of said walls defining said center section, said distributor unit outlet portion having a cross-section of smaller area of that of said inlet opening, a deflector unit positioned on said room wall and spaced upwardly substantially apart from said outlet passage of said distributor and being vertically aligned therewith, said deflector having a surface curving upwardly and inwardly of said room interior formed in part by said wall and curving between a position approximately parallel to said wall surface toward a position perpendicular to said wall surface, at least one supply conduit for directing forced air to said distributor unit inlet and at least one return conduit for returning air having passed through said distributor and over said deflector to said forced air supply means.

2. A forced air circulation system as defined in claim 1 wherein said at least one of said walls of said distributor unit forming said center section is a straight wall section positioned substantially vertically in use.

3. A forced air circulation system as defined in claim 1 wherein said at least one of said walls of said distributor unit forming said center section is a straight wall section positioned substantially vertically in use and the other of said walls tapers gradually toward said vertical wall as said other wall extends upwardly.

4. A forced air circulation system as defined in claim 1 wherein said distributor unit further includes a plurality of air flow directing vanes extending generally vertically and having portions affixed respectively to the said spaced apart portions of said walls defining said center section to direct air flow in a substantially vertical direction as it flows through said outlet passage.

5. A forced air circulation system as defined in claim 1 wherein said distributor unit is incorporated into said room wall structure, with one of said distributor unit walls forming a baseboard cover section and the other of said distributor unit walls comprising the lower margin of said room wall, said other wall being tapered downwardly and inwardly toward the center section of said wall, said distributor center section being also defined in part by a trough lying beneath the lower margins of said wall forming said baseboard cover section and said other wall.

6. A forced air circulation system as defined in claim 1 wherein said distributor unit is a dual outlet passage unit having two outlet passages positioned parallel to each other, said distributor unit outlet passages being spaced apart a distance substantially equal to the thickness of said room wall, said distributor unit including a pair of exterior, substantially vertical walls and a pair of interior, angularly disposed walls, said distributor unit center section being formed in part by a trough member extending between the lower edges of said exterior vertical walls, said outlet passages being formed between the upper edges of said exterior walls and the upper margins of said interior, angularly disposed walls respectively.

7. A forced air circulation system for an enclosed room, said room including a building floor, plural building walls and a work area floor spaced apart from and supported with respect to said building floor, at least one intermediate floor dividing the area beneath said work floor into separate spaces, one of said space comprises a forced air circulation supply plenum, said supply plenum being substantially unobstructed by wires, cables, or mechanical services, means for supplying forced air to said supply plenum, and a supply conduit extending between a portion of said forced air circulation supply plenum and at least one air distributor unit, said air distributor unit including an inlet, an elongated center section defined in part by tapered sidewalls converging toward an outlet passage of thin, elongated cross section defined by the opposed upper edges of said tapered sidewalls, said air distributor unit being positioned so as to form a baseboard associated with one of said plural building walls, said one building wall having thereon at least one air deflector positioned above said distributor unit outlet passage, and being vertically aligned with said distributor unit, said air deflector having a lower portion extending parallel to said building wall, a center section curving upwardly and toward the room interior and an upper, inner edge directed toward said room interior.

8. A forced air circulation system as defined in claim 7 which further includes a return air plenum, said system including passages extending from above said work floor into said return air plenum, said system further including at least one elongated air collection unit adjacent the baseboard of at least one other building wall, said collection unit having an air inlet and an air outlet communicating with said return air plenum.

9. A forced air circulation system as defined in claim 8 wherein said separate spaces beneath said work floor and further include a third space adapted to receive mechanical and electrical services in mechanically isolated relation to said supply and return air plenums, with each of said plenums having vertical passages associated therewith, said vertical passages extending through and being isolated from said third space, said vertical passages being in communication with said distributor units and said collector units respectively.

10. A forced air circulation system for an enclosed room, said room including a building floor, building walls and a work area floor spaced apart from and supported with respect to said building floor, at least one wall having an interior surface portion facing the interior of said room, said wall extending vertically and having a center section and at least an inwardly facing wall section, said wall having a lower margin in the form of a beveled surface extending upwardly and outwardly so as to join said inwardly facing surface of said wall a short distance above the level of said work floor, a baseboard cover unit positioned in contact with said floor and extending substantially vertically upwardly therefrom, said vertical wall having an upper edge spaced very slightly apart from the upper edge of the tapered wall to define therebetween an elongated passage of narrow cross-section, a plurality of vanes extending generally vertically between said walls, and a trough extending between the lower portions of said walls and lying at or below the level of said floor, said trough having surfaces defining an inlet opening therein, whereby forced air supplied to said trough will be caused to flow in a thin sheet along said building interior surface, said building wall having positioned thereon a deflector unit curving upwardly and inwardly of said wall and being spaced apart a significant distance above said outlets, and means for supplying forced air to said trough inlet opening.

11. A room including an air distribution system therein, said room being defined in part by a floor and by a plurality of walls directed inwardly towards the interior of said room and having flat, obstruction-free surfaces, a plurality of air distributor units disposed along the baseboard areas of said walls, with each distributor unit including a center section extending longitudinally along said baseboard, a flow-forming section including a pair of opposed walls tapering towards each other and being spaced closely apart from each other at their uppermost ends to define therebetween an elongated outlet area of narrow cross-section, said walls having deflector units disposed in the areas above said distributor units, said deflector units having curved inner surfaces extending upwardly and curving inwardly towards the room interior, at least one supply conduit for supplying forced circulation air to the interior of said distributor units and at least one return conduit for returning air to said supply source for recirculation.

12. A room as defined in claim 11 which further includes means for collecting return air from said room, said means comprising at least one return air collector unit positioned in the baseboard area of a wall spaced apart from the wall associated with said distributor unit, said collector unit having an open area extending substantially along the baseboard area of said wall for collection of return air from a wide area and further including an outlet for connection to a conduit communicating with a return air area.

13. A room as defined in claim 11, wherein said at least one supply conduit for supplying said forced circulation air to said interiors of said distributor units comprises a substantially continuous and unobstructed air plenum extending beneath said work area floor, said plenum having at least one supply inlet in communication with a source of conditioned air, and at least one supply outlet in communication with said interiors of said distributor units.

14. A room as defined in claim 13 wherein said at least one return conduit comprises a substantially continuous and unobstructed air plenum disposed beneath said work area floor, said plenum having at least one return air inlet and one return air outlet, said return air outlet being in communication with said supply source for air recirculation.

* * * * *